US011313175B2

(12) United States Patent
Leung et al.

(10) Patent No.: US 11,313,175 B2
(45) Date of Patent: Apr. 26, 2022

(54) MUD MOTOR CATCH WITH CATCH INDICATION AND ANTI-MILLING

(71) Applicant: Halliburton Energy Services, Inc., Houston, TX (US)

(72) Inventors: Philip Park-Hung Leung, Edmonton (CA); Steven Graham Bell, Houston, TX (US); Steven Park, Edmonton (CA); Mohamed Mourad, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 70 days.

(21) Appl. No.: 16/879,076

(22) Filed: May 20, 2020

(65) Prior Publication Data

US 2021/0172251 A1 Jun. 10, 2021

Related U.S. Application Data

(60) Provisional application No. 62/943,372, filed on Dec. 4, 2019.

(51) Int. Cl.
*E21B 4/02* (2006.01)
*E21B 21/08* (2006.01)

(52) U.S. Cl.
CPC ..... *E21B 4/02* (2013.01); *E21B 21/08* (2013.01)

(58) Field of Classification Search
CPC ..... E21B 4/02; E21B 21/08
See application file for complete search history.

(56) References Cited

U.S. PATENT DOCUMENTS 9,194,181 B2 11/2015 Connell et al.
9,840,909 B2 12/2017 Lee et al.
(Continued)

FOREIGN PATENT DOCUMENTS

AU 2014221289 3/2015
CA 2724161 6/2012
(Continued)

OTHER PUBLICATIONS

TDI—Rotor Catchers—currently in use in Sperry Motor fleets—they do not have anti milling or feedback. They are prone to milling after catching.

(Continued)

*Primary Examiner* — Dany E Akakpo
(74) *Attorney, Agent, or Firm* — Thomas Rooney; C. Tumey Law Group PLLC

(57) ABSTRACT

A rotor catch system includes a catch stem having a proximal end coupled to a rotor of a mud motor system and a distal end positioned within a sub housing of a drill string, a catch feature having a top portion and a spindle portion extending from the top portion and coupled to the distal end of the catch stem, a housing catch feature extending radially inward from an inner surface of the sub housing, and a catch bushing positioned between the top portion of the catch feature and the housing catch feature. The housing catch feature restrains axial movement of the catch bushing in the active catch state via contact between the catch bushing and the housing catch feature, and the catch bushing restrains axial movement of the catch feature in the active catch state via contact between the catch feature and the catch bushing.

20 Claims, 10 Drawing Sheets

(56) References Cited

U.S. PATENT DOCUMENTS

| | | | | |
|---|---|---|---|---|
| 9,976,349 | B2 | 5/2018 | Altimas | |
| 9,982,485 | B2 | 5/2018 | Murray et al. | |
| 10,465,510 | B2 | 11/2019 | Baudoin | |
| 2014/0060936 | A1* | 3/2014 | Connell | E21B 21/103 175/107 |
| 2017/0058606 | A1 | 3/2017 | Gharib et al. | |
| 2017/0260814 | A1 | 9/2017 | Gharib et al. | |
| 2017/0328133 | A1 | 11/2017 | Savage et al. | |
| 2017/0335628 | A1 | 11/2017 | Savage et al. | |
| 2017/0343046 | A1 | 11/2017 | Park et al. | |
| 2017/0356289 | A1 | 12/2017 | Baudoin | |
| 2018/0051517 | A1 | 2/2018 | Savage et al. | |
| 2018/0066480 | A1 | 3/2018 | Savage et al. | |
| 2018/0073299 | A1 | 3/2018 | Gharib et al. | |
| 2018/0112468 | A1* | 4/2018 | Savage | E21B 4/00 |
| 2018/0291693 | A1 | 10/2018 | Savage | |
| 2018/0371839 | A1 | 12/2018 | Sonar et al. | |
| 2019/0154081 | A1 | 5/2019 | Panda et al. | |
| 2019/0352966 | A1 | 11/2019 | Leung | |

FOREIGN PATENT DOCUMENTS

| | | | |
|---|---|---|---|
| WO | 2014035901 | | 3/2014 |
| WO | 2014035901 | A2 | 3/2014 |
| WO | 2017027964 | A1 | 2/2017 |

OTHER PUBLICATIONS

Nov.
SperryDrill "Drop-ring" style rotor catcher.
SperryDrill XL Rotor catchers.
SperryDrill "Two-piece" catch sub style rotor catchers.
International Search Report for Application No. PCT/US2020/037058 dated Sep. 21, 2020.

* cited by examiner

MUD MOTOR CATCH WITH CATCH INDICATION AND ANTI-MILLING

BACKGROUND

Various types of tools can be used to form wellbores in subterranean formations for recovering hydrocarbons such as oil and gas lying beneath the surface. Examples of such tools include rotary drill bits, hole openers, reamers, and coring bits. One common type of drilling operation uses a mud motor system to drive rotation of such tools to drill the wellbore. Unfortunately, some well conditions may lead to failure of the mud motor system. Such failure may cause a lower portion of a mud motor housing to separate or disconnect from an upper portion of the mud motor housing, which may disrupt drilling operations. Further, the separation or disconnection may hinder retrieval of the tool and at least a portion of the mud motor system may remain in the wellbore.

Traditionally, rotor catch systems may be used to maintain a connection between a separated portion (e.g., lower portion) of the mud motor housing and the upper portion of the mud motor housing in the event of failure. A common rotor catch system may include a catch device coupled to a rotor of the mud motor. The catch device may be restrained from moving in a downhole direction by a portion of the mud motor housing and/or a restraining ring coupled to the mud motor housing. As such the common rotor catch system may maintain a connection between the separated portion of the mud motor housing and the upper portion of the mud motor housing.

Unfortunately, failure of the mud motor housing may not be detected during drilling operation using common rotor catch systems. As such, the rotor of the mud motor system may continue to rotate in the wellbore for an extended period after separation of the mud motor housing. Rotation of the catch device induced by rotation of the rotor may cause the catch device to shear or mill through the mud motor housing and/or the restraining ring coupled to the mud motor housing, which may break the connection between the lower portion of the mud motor housing and the upper portion of the mud motor housing and hinder efficiency of drilling operations.

BRIEF DESCRIPTION OF THE DRAWINGS

These drawings illustrate certain aspects of some examples of the present disclosure and should not be used to limit or define the disclosure.

DETAILED DESCRIPTION

Provided are systems and methods for wellbore drilling and, more particularly, example embodiments may include a rotor catch system configured to provide an indication of a mud motor failure to the surface. Systems and methods may be configured to prevent milling of the rotor catch system through a housing of the rotor catch system, which may maintain a connection with at least a portion of the mud motor system that has separated due to the mud motor failure.

Figure 1:
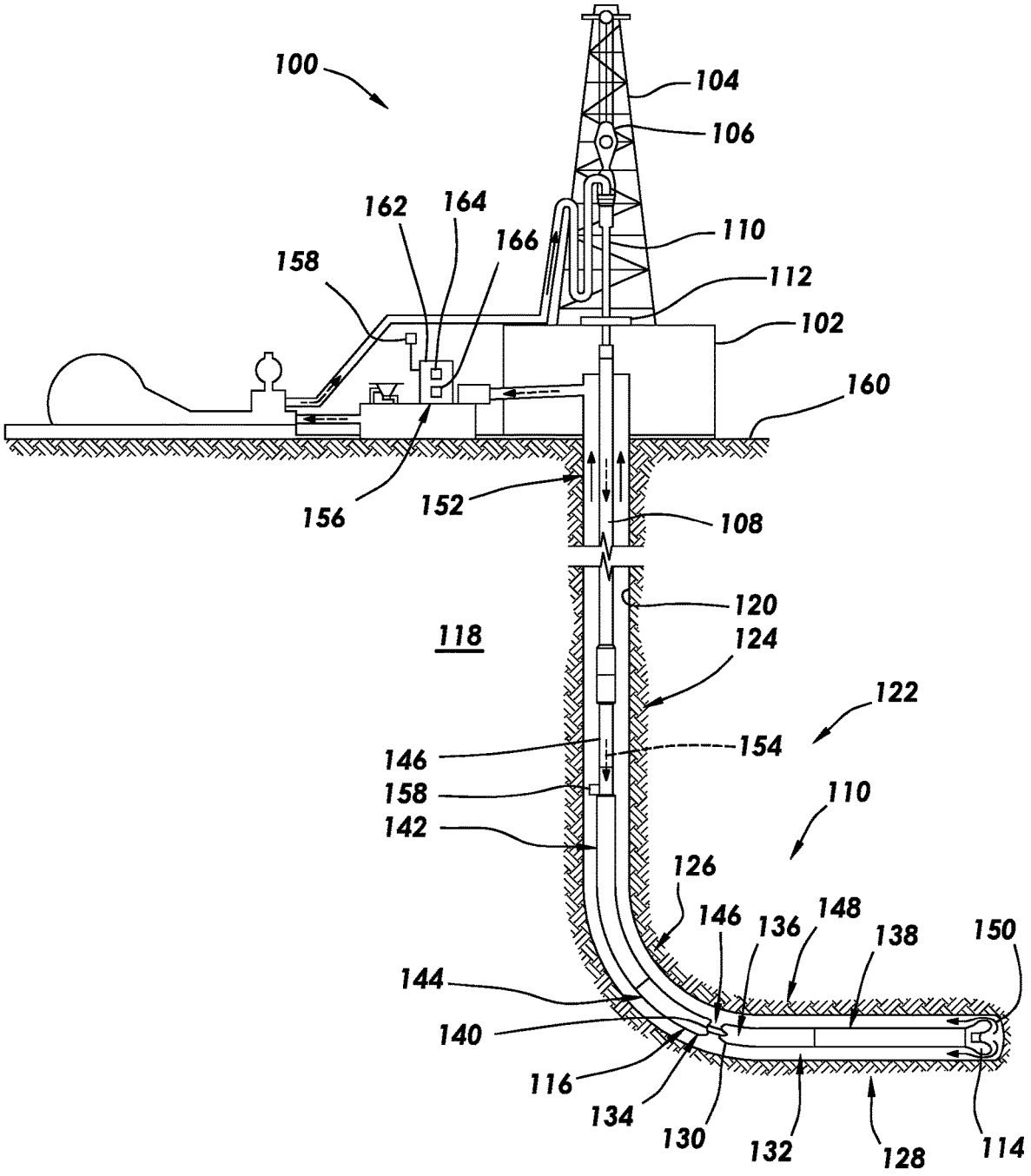
FIG. 1 illustrates a side elevation, partial cross-sectional view of an operational environment for a drilling system in accordance with one or more embodiments of the disclosure.

FIG. 1 illustrates a side elevation, partial cross-sectional view of an operational environment for a drilling system in accordance with one or more embodiments of the disclosure. It should be noted that while FIG. 1 generally depicts a land-based drilling assembly, those skilled in the art will readily recognize that the principles described herein are equally applicable to subsea drilling operations that employ floating or sea-based platforms and rigs, without departing from the scope of the disclosure. As illustrated, the drilling assembly 100 includes a drilling platform 102 that supports a derrick 104 having a traveling block 106 for raising and lowering a drill string 108. The drill string 108 includes, but is not limited to, drill pipe, a bottom hole assembly 110, and any other suitable tools, as generally known to those skilled in the art. While not shown, coiled tubing may be used instead of convention drill pipe for supporting the bottom hole assembly 110 in wellbore 120. The bottom hole assembly 110 includes drill bit 114 attached to a distal end 112 of the drill string 108. The bottom hole assembly 110 also includes a mud motor system 116 configured to drive rotation of the drill bit 114. As the drill bit 114 rotates, it may penetrate various subterranean formations 118 to create the wellbore 120.

In the illustrated embodiment, the wellbore 120 includes multiple types of well sections 122, such as vertical well sections 124, curved well sections 126 (e.g., dog leg well sections), and lateral well sections 128. In other embodiments, the wellbore 120 may include other types or combinations of well sections 122 based at least in part on drilling operations. Further, pressure, temperature, and other well conditions may vary along the wellbore 120. Under some well conditions, a portion of the bottom hole assembly 110 may fail in the curved well section 126. Alternatively, the portion of the bottom hole assembly 110 may fail in the other well sections under certain conditions. Failure of the bottom hole assembly 110 may include failure of a mud motor housing 130 (e.g., a stator) of the mud motor system 116. For example, threads of the mud motor housing 130 configured to couple the mud motor housing 130 to a sub housing 144 may fail. Alternatively, another portion of the mud motor housing 130 may fail. Failure of the mud motor housing 130 may cause a lower portion 132 of the mud motor housing 130 to separate from an upper portion 134 of the mud motor housing 130. Such failure of the mud motor housing 130 may also cause other components of the bottom hole assembly 110 (e.g., a rotor 136 of the mud motor system 116, a transmission section 138, the drill bit 114, etc.) to separate from the upper portion 134 of the mud motor housing 130.

As illustrated, the mud motor system 116 includes a rotor catch system 140 to maintain a connection between the rotor 136 of the mud motor system 116 and a stable portion 142 of the drill string 108 (e.g., the upper portion 134 of mud motor housing 130, the sub housing 144, drill pipe 146 positioned above the sub housing 144, etc.) positioned up hole of a point of failure in response to failure of the mud motor housing 130. The rotor catch system 140 supports the rotor 136 such that the rotor 136 remains connected to the stable portion 142 of the drill string 108 during continued drilling operations and/or retrieval of the drill string 108. Moreover, the rotor catch system 140 supports additional components of the bottom hole assembly 110 that are connected to the rotor 136.

The rotor catch system 140 may operate in either a passive state or an active catch state. During normal drilling operations, the rotor catch system 140 operates in the passive state (e.g., the rotor catch system 140 is disengaged). In the active catch state, the catch rotor catch system 140 is engaged to restrain relative axial movement of the rotor 136 such that the rotor 136 remains connected to the stable portion 142 of the drill string 108. The rotor catch system 140 transitions from the passive state to the active catch state in response to axial movement of the rotor 136 with respect to the stable portion 142 of the drill string 108 (e.g., a portion of the drill string 108 positioned up hole from the rotor catch system 140). Failure of the mud motor housing 130 may cause axial movement of the rotor 136 with respect to the stable portion 142 of the drill string 108. Accordingly, failure of the mud motor housing 130 may cause the rotor catch system 140 to transition from the passive state to the active state.

For example, the lower portion 132 of the mud motor housing 130 may be severed from the upper portion 134 of the mud motor housing 130, permitting separation of the lower portion 132 of the mud motor housing 130 from the upper portion 134 of the mud motor housing 130. As the other components of the bottom hole assembly 110 (e.g., lower components 148) positioned downhole the lower portion 132 of mud motor housing 130 are coupled to the lower portion 132 of the mud motor housing 130, the lower components 148 may also be separated from the upper portion 134 of the mud motor housing 130. Thus, the lower components 148 may move in a downhole direction based at least in part on gravitational forces. As illustrated, the rotor 136 of the mud motor system 116 is at least partially supported by the lower components 148. As such, failure of the mud motor housing 130 that causes movement of the lower components in the downhole direction, also causes axial movement of the rotor 136 with respect to the stable portion 142 of the drill string 108.

Alternatively, the lower components 148 may be in contact with a bottom 150 of the wellbore 120 such that the lower components 148 may not move in a downhole direction in response to failure of the mud motor housing 130. Instead, the axial movement of the rotor 136 with respect to the stable portion 142 of the drill string 108, resulting from the failure of mud motor housing 130, may be caused by retrieval of the upper portion 134 while the lower components 148 and the rotor 136 are disconnected from the stable portion 142 of the drill string 108 (e.g., the upper portion 134 of the mud motor housing 130). Accordingly, in the active catch state, the rotor catch system 140 may restrain axial movement of the rotor 136 with respect to the stable portion 142 of the drill string 108 such that the rotor 136 remains connected to the stable portion 142 of the drill string 108. Thus, as the rotor 136 and the lower components 148 remain connected to the stable portion 142, retrieving the upper portion 134 may also retrieve the rotor 136 and the lower components 148.

During operations, the rotor catch system 140 may generate a pressure spike in a drilling fluid 152 (e.g., drilling mud) positioned up hole from the rotor catch system 140 in response to transitioning to the active catch state. The rotor catch system 140 generates the pressure spike via sealing or restricting a flow path 154 for the drilling fluid 152 through the drill string 108. A detection system 156 is configured to detect the pressure spike generated by the rotor catch system 140 in response to transitioning to the active catch state. Further, the detection system 156 is configured to determine whether the rotor 136 moved axially with respect to the stable portion 142 of the drill string 108 based at least in part on a pressure of a detected pressure differential exceeding a predetermined pressure differential amount. The pressure spike generated by the rotor catch system 140 is greater than the predetermined pressure differential amount such that the detection system determines that the rotor 136 moved axially with respect to the stable portion 142 of the drill string 108 in response to detecting the pressure spike generated by the rotor catch system 140. Alternatively, the detection system may be configured detect a flow profile of the drilling fluid 152.

The detection system 156 may include at least one pressure transducer 158 configured to measure a pressure of the drilling fluid 152. As illustrated, the pressure transducer 158 may be positioned within the wellbore 120. In particular, the pressure transducer 158 may be positioned proximate the mud motor system 116. Further, the detection system 156 may include another pressure transducer 158 positioned above a surface 160 of the wellbore 120. Alternatively, the detection system 156 may include the pressure transducer 158 positioned proximate the mud motor system 116, positioned above the surface 160 of the wellbore 120, positioned in another suitable location for measuring the pressure of the drilling fluid 152, or some combination thereof. Moreover, the at least one pressure transducer 158 may provide a catch indication (e.g., output a pressure signal with measured pressure data).

The detection system 156 may further include a controller 162 that receives the catch indication (e.g., the pressure signals from the at least one pressure transducer 158). As illustrated, the controller 162 may include a processor 164 and a memory device 166. The processor 164 may include one or more processing devices, and the memory device 166 may include one or more tangible, non-transitory, machine-readable media. By way of example, such machine-readable media may include RAM, ROM, EPROM, EEPROM, or optical disk storage, magnetic disk storage or other magnetic storage devices, or any other medium which may be used to carry or store desired program code in the form of machine-executable instructions or data structures and which may be accessed by the processor or by other processor-based devices (e.g., mobile devices). The memory device 166 may be configured to store controller instructions executable by the processor 164 to output various control system signals. For example, the processor 164 may execute instructions to determine a pressure differential for the drilling fluid 152 in the wellbore 120 based at least in part on the pressure signal received from the pressure transducer 158. Further, the processor 164 of the controller 162 may execute instructions to compare the received differential pressure to a predetermined pressure differential range to determine whether the rotor 136 moved axially with respect to the stable portion 142 of the drill string 108. The controller 162 may be configured to determine that the rotor 136 moved axially with respect to the stable portion 142 of the drill string 108 in response to a detected pressure differential between 300 pounds per square inch (psi) to 700 psi (2068 kilopascals [kPa] to 4826 kPa). Alternatively, the controller 162 may be configured to determine that the rotor 136 moved axially with respect to the stable portion 142 of the drill string 108 in response to a detected pressure differential between 400 psi to 600 psi (2757 kPa to 4136 kPa). However, any suitable pressure differential range may be used by the controller 162 to determine that the rotor 136 moved axially with respect to the stable portion 142 of the drill string 108.

Figure 2:
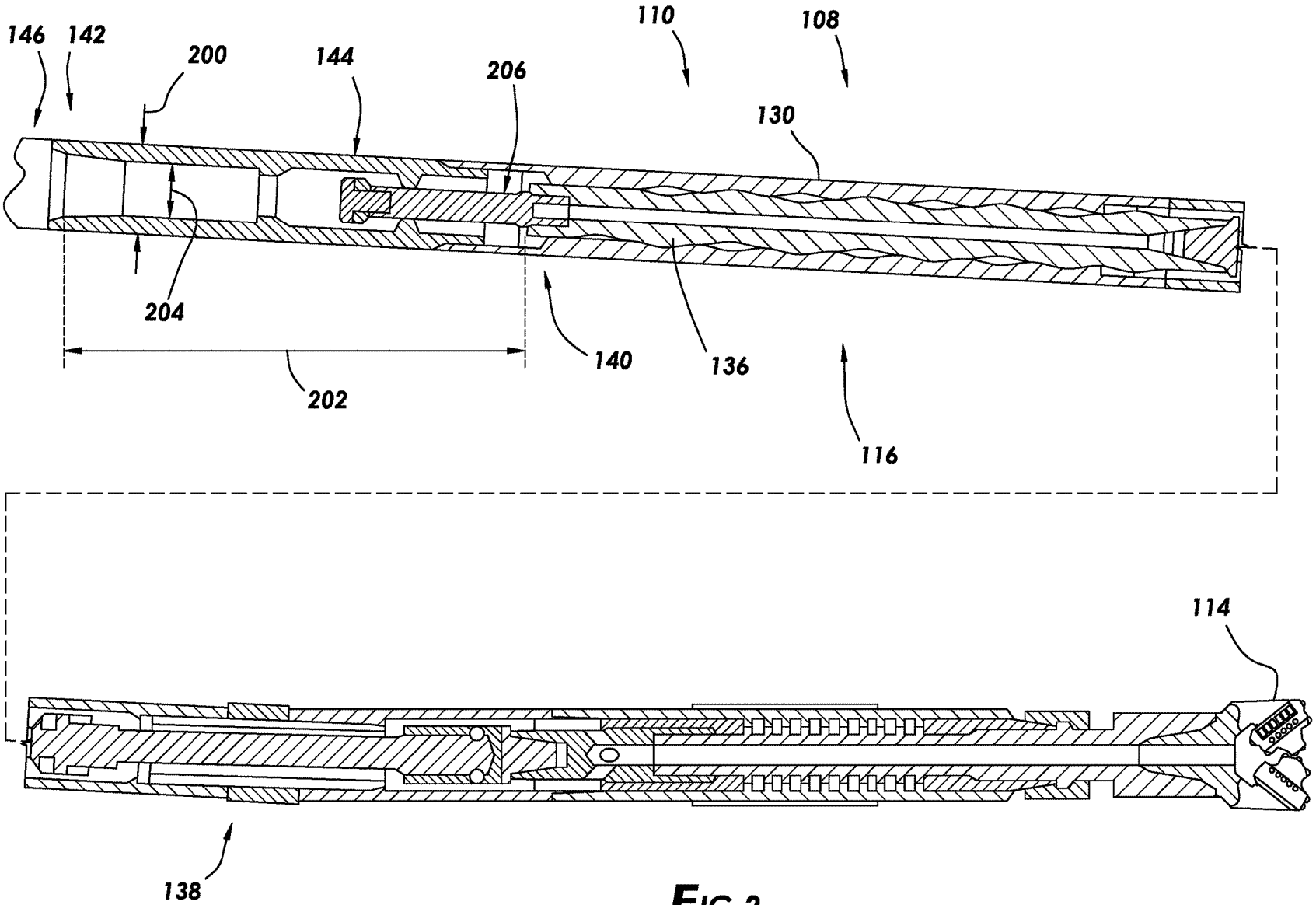
FIG. 2 is a cross-sectional view of an embodiment of a bottom hole assembly having a mud motor system that may employ the principles of the present disclosure.

FIG. 2 illustrates a cross-sectional view of an embodiment of a bottom hole assembly 110 having a mud motor system 116 that may employ the principles of the present disclosure. The mud motor system 116 may include the mud motor housing 130 (e.g., stator) coupled to the sub housing 144 of the drill string 108. The mud motor system 116 is coupled to the sub housing 144 via a threaded connection. However, any suitable connection type may be used to couple the mud motor system 116 to the sub housing 144. Moreover, the mud motor housing 130 is positioned downhole of the sub housing 144. As illustrated, the sub housing 144 may be part of the stable portion 142 of the drill string 108. The sub housing 144 is configured to connect the mud motor housing 130 to the drill pipe 146 of the drill string 108. The drill pipe 146 is also a part of the stable portion 142 of the drill string. Moreover, the sub housing 144 may have a uniform outer sub housing diameter 200 along an axial length 202 of the sub housing 144. Alternatively, the outer diameter 200 of the sub housing 144 may vary along the axial length 202 of the sub housing 144. An inner diameter 204 of the sub housing 144 may also vary along the axial length 202 of the sub housing 144.

As illustrated, the rotor catch system 140 may be positioned at least partially within the sub housing 144. A proximal end 206 of the rotor catch system 140 is coupled to the rotor 136 of the mud motor system 116. The rotor 136 is positioned at least partially withing the mud motor housing 130 (e.g., stator). The rotor 136 is configured to rotate with respect to the mud motor housing 130 in response to flow of the drilling fluid 152 through the mud motor housing 130 between the rotor 136 and the mud motor housing 130. Torque from the rotation of the rotor 136 is transferred through the bottom hole assembly 110 to turn the drill bit 114 (e.g., referring to FIG. 1). The bottom hole assembly 110 may include the transmission section 138 positioned downhole the rotor 136. The transmission section 138 is configured to transfer torque from the rotor 136 to the drill bit 114 to cause the drill bit 114 to rotate.

Figure 3A:
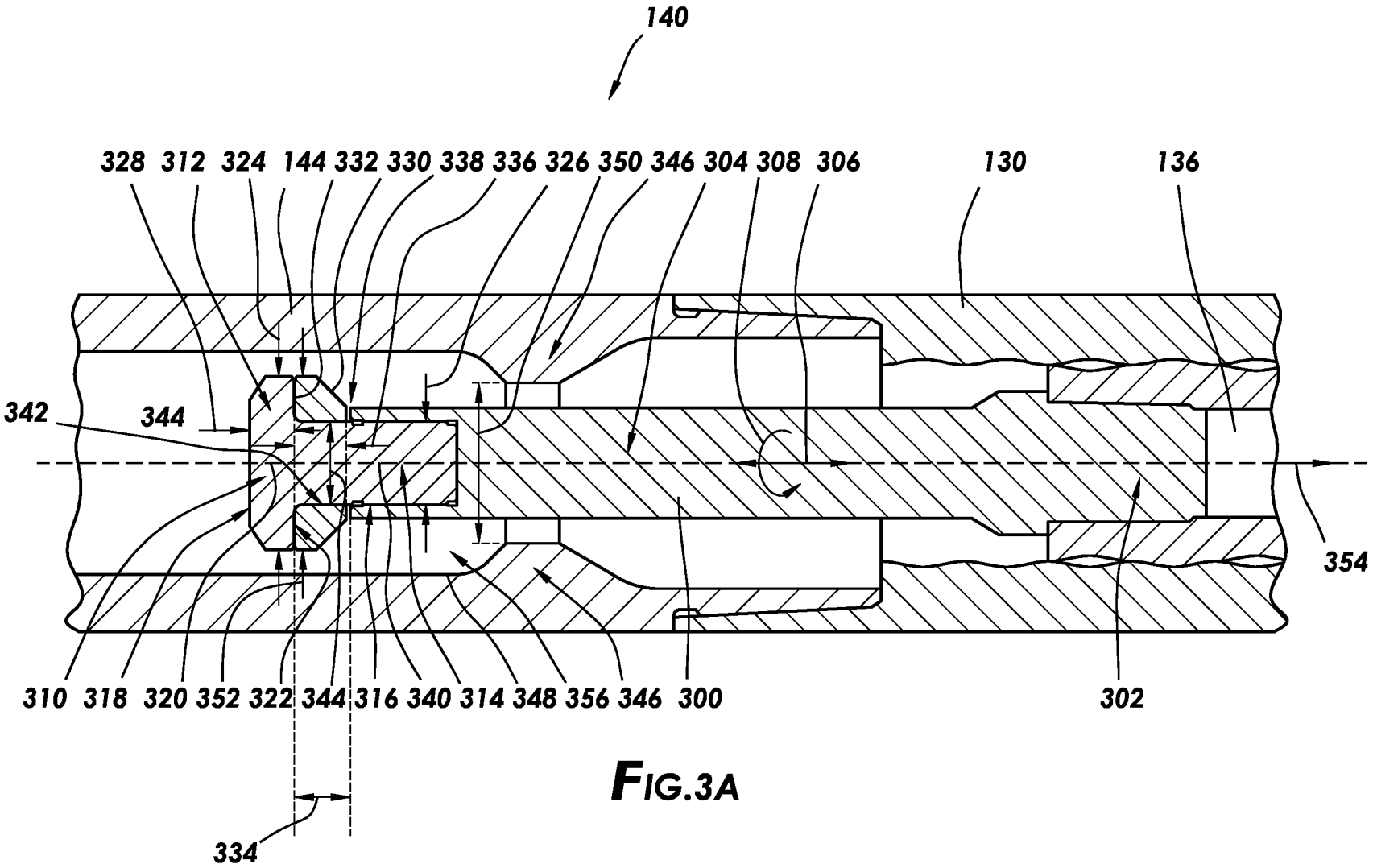
FIGS. 3A and 3B illustrate cross-sectional views of the rotor catch system in a passive state and an active catch state, respectively, in accordance with example embodiments of the disclosure.
Figure 3B:
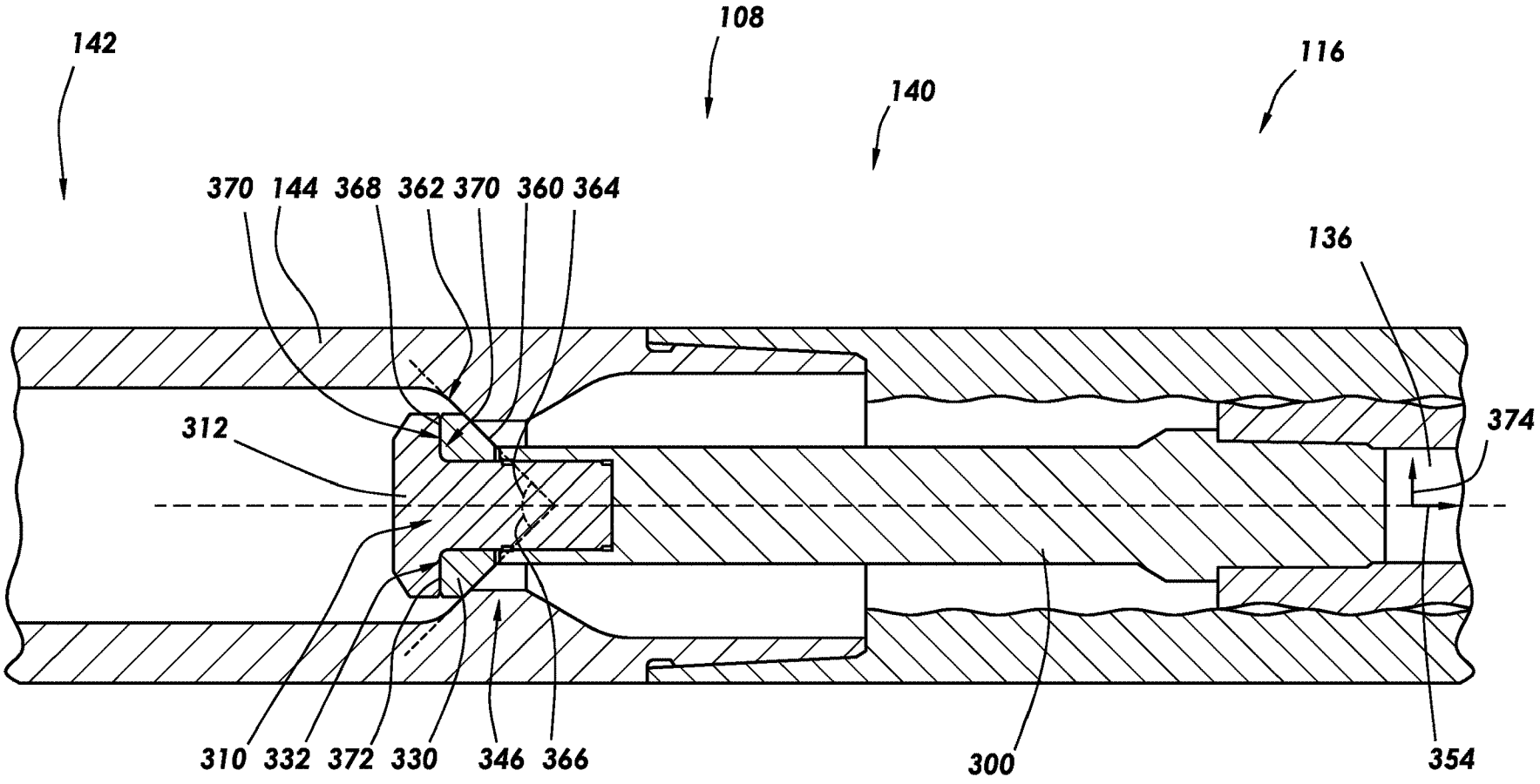

FIGS. 3A and 3B illustrate cross-sectional views of the rotor catch system 140 in a passive state and an active catch state, respectively, in accordance with example embodiments of the disclosure. As illustrated in FIG. 3A, the rotor catch system 140 includes a catch stem 300. The catch stem 300 is positioned at least partially within the sub housing 144 and at least partially within the mud motor housing 130. As illustrated, a proximal end 302 of the catch stem 300 is coupled to the rotor 136 of a mud motor system 116, and a distal end 304 of the catch stem 300 is positioned within the sub housing 144 of a drill string 108. The catch stem 300 is rigidly coupled to the rotor 136 such that axial and/or rotational movement of the rotor 136 causes the catch stem 300 to respectively move in an axial direction 306 and/or a rotational direction 308.

Moreover, the rotor catch system 140 includes a catch feature 310 having a top portion 312 and a spindle portion 314. The spindle portion 314 is coupled to the distal end 304 of the catch stem 300. As illustrated, the spindle portion 314 may extend into a bore 316 disposed in the distal end 304 of the catch stem 300. The spindle portion 314 is threaded into the bore 316 to couple the spindle portion 314 to the catch stem 300. Alternatively, the spindle portion 314 may be welded, press-fit, or otherwise coupled to the catch stem 300. Further, in another embodiment, the distal end 304 of the catch stem 300 may be threaded into a bore in the spindle portion 314 or otherwise coupled to the bore in the spindle portion 314.

The top portion 312 of the catch feature 310 may be formed at a distal end 318 of the catch feature 310. The top portion 312 extends radially outward further than the spindle portion 314 with respect to a central axis 320 of the catch feature 310 to form a lip 322 for the catch feature 310 at a transition from the spindle portion 314 to the top portion 312. That is, a top portion diameter 324 of the top portion 312 is greater than a spindle portion diameter 326 of the spindle portion 314. The top portion 312 may include a taper along an axial length 328 of the top portion 312. Alternatively, the top portion 312 may have a uniform diameter along the axial length 328 of the top portion 312.

The rotor catch system 140 further may include a catch bushing 330 positioned downhole the top portion 312 of the catch feature 310. In particular, the catch bushing 330 is positioned between the top portion 312 of the catch feature 310 and a housing catch feature 346. The catch bushing 330 may be any metallic material, including metallic materials treated or coated for anti-erosion or anti-galling. Coatings and treatments may include nitriding, industrial chrome, high velocity oxy-acetylene fuel (HVOF) spray, or laser cladded. The catch bushing 330 is positioned between the catch stem 300 and the top portion 312 of the catch feature 310. In particular, the catch bushing 330 is positioned between a proximal end 332 of the top portion 312 and the distal end 304 of the catch stem 300. An axial position of the top portion 312 may be fixed with respect to the catch stem 300. A fixed distance 334 between the proximal end of the top portion 312 and the distal end of the catch stem 300 is greater than an axial length 336 of the catch bushing 330 such that a gap 338 is positioned between the top portion 312 and the catch bushing 330, the catch bushing 330 and the catch stem 300, or some combination thereof. The fixed distance 334 between the proximal end 332 of the top portion 312 and the distal end 304 of the catch stem 300 may be between 0.01 inches to 0.09 inches (0.0254 centimeters [cm] to 0.2286 cm) greater than the axial length 336 of the catch bushing 330.

Moreover, the catch bushing 330 has an annular shape with an axial bore 342 through a central axis 340 of the catch bushing 330. The spindle portion 314 of the catch feature 310 is configured to extend axially through the catch bushing 330, via the axial bore 342, and couple the distal end 304 of the catch stem 300. A diameter 344 of the axial bore 342 of the catch bushing 330 is greater than spindle portion diameter 326 such that the catch feature 310 may rotate with respect to the catch bushing 330.

The rotor catch system 140 includes the housing catch feature 346. As illustrated, the housing catch feature 346 extends radially inward from an inner surface 348 of the sub housing 144 of the drill string 108. Thus, the housing catch feature 346 is a section of the sub housing 144 having a reduced inner diameter 350. The reduced inner diameter 350 is smaller than an outer diameter 352 of the catch bushing 330 such that the housing catch feature 346 blocks the catch bushing 330 from moving past the housing catch feature 346. In particular, the housing catch feature 346 restrains axial movement of the catch bushing 330 in a downhole direction 354 via contact between the catch bushing 330 and the housing catch feature 346. In another embodiment, the housing catch feature 346 may be a ring or other suitable feature coupled to the inner surface 348 of the sub housing 144.

The rotor catch system 140 is shown in a passive state. The rotor catch system 140 may generally be in the passive state during drilling operations. In the passive state the catch bushing 330 of the rotor catch system 140 is positioned up hole from the housing catch feature 346. A passive gap 356 between the catch bushing 330 and the housing catch feature 346 is sufficiently large in the passive state to prevent incidental contact between the catch bushing 330 the housing catch feature 346, which may prematurely wear the catch bushing 330, housing catch feature 346, the catch feature 310, or some combination thereof.

As illustrated in FIG. 3B, the rotor catch system 140 is in an active catch state. As set forth above, a mechanical disconnection of a portion of the drill string 108 positioned downhole the housing catch feature 346 causes axial movement of the catch stem 300 in the downhole direction 354. Contact between the catch bushing 330 and the housing catch feature 346 caused by axial movement of the catch stem 300 in the downhole direction causes the rotor catch system 140 to transition to the active catch state. In the active catch state, the housing catch feature 346 contacts the catch bushing 330 to restrain axial movement of the catch bushing 330 in the downhole direction 354. Further, the catch bushing 330 restrains axial movement in the downhole direction of the catch feature 310 in the active catch state. As set forth above, the catch feature 310 is coupled to the catch stem 300, and the catch stem 300 is coupled to the rotor 136 of the mud motor system 116. As such, restraining axial movement in the downhole direction 354, via contact between the housing catch feature 346 and the catch bushing 330, maintains the connection of the rotor 136 with the stable portion 142 (e.g., sub housing 144) of the drill string 108.

The catch bushing 330 includes a tapered bushing portion 360 along at least a portion of the axial length 336 of the catch bushing 330. The tapered bushing portion 360 is formed on a downhole facing surface of the catch bushing 330. The tapered bushing portion 360 may be configured to contact the housing catch feature 346. During transition from the passive state to the active catch state, the tapered bushing portion 360 guides alignment of the catch bushing 330 with respect to the housing catch feature 346. The catch bushing 330 is colinear with the housing catch feature 346 in the active catch state.

Moreover, the housing catch feature 346 may include a housing tapered portion 362. The housing tapered portion 362 is configured to contact the tapered bushing portion 360 in the active catch state. A housing taper angle 364 of the housing tapered portion 362 corresponds to a bushing taper angle 366 of the tapered bushing portion 360 such that the housing tapered portion 362 is substantially parallel to the tapered bushing portion 360. Having the housing tapered portion 362 positioned substantially parallel to the tapered bushing portion 360 may reduce uneven wear of the housing tapered portion 362 and/or the tapered bushing portion 360, which may reduce milling, and/or failure of the catch bushing 330 and/or the housing catch feature 346.

Moreover, a bushing surface 368 of a distal end 370 of the catch bushing 330 is substantially parallel with a catch feature surface 372 of the proximal end 332 of the top portion 312 of the catch feature 310. In the active catch state, the bushing surface 368 of the distal end 370 of the catch bushing 330 contacts the catch feature surface 372 of the proximal end 332 of the top portion 312 of the catch feature 346 as the catch feature 346 rotates with respect to the catch bushing 330. Having the bushing surface 368 and the catch feature surface 372 substantially parallel may provide a substantially even contact between the bushing surface 368 and the catch feature surface 372 such that the bushing surface 368 and the catch feature surface 372 may wear substantially uniformly along a radial direction 374 of the bushing surface 368 and the catch feature surface 372. Uniform wear of the bushing surface 368 and the catch feature surface 372 may increase a life span of the rotor catch system 140 by reducing potential milling, and/or excessive wear of the catch feature 310 and/or catch bushing 330.

Figure 3C:
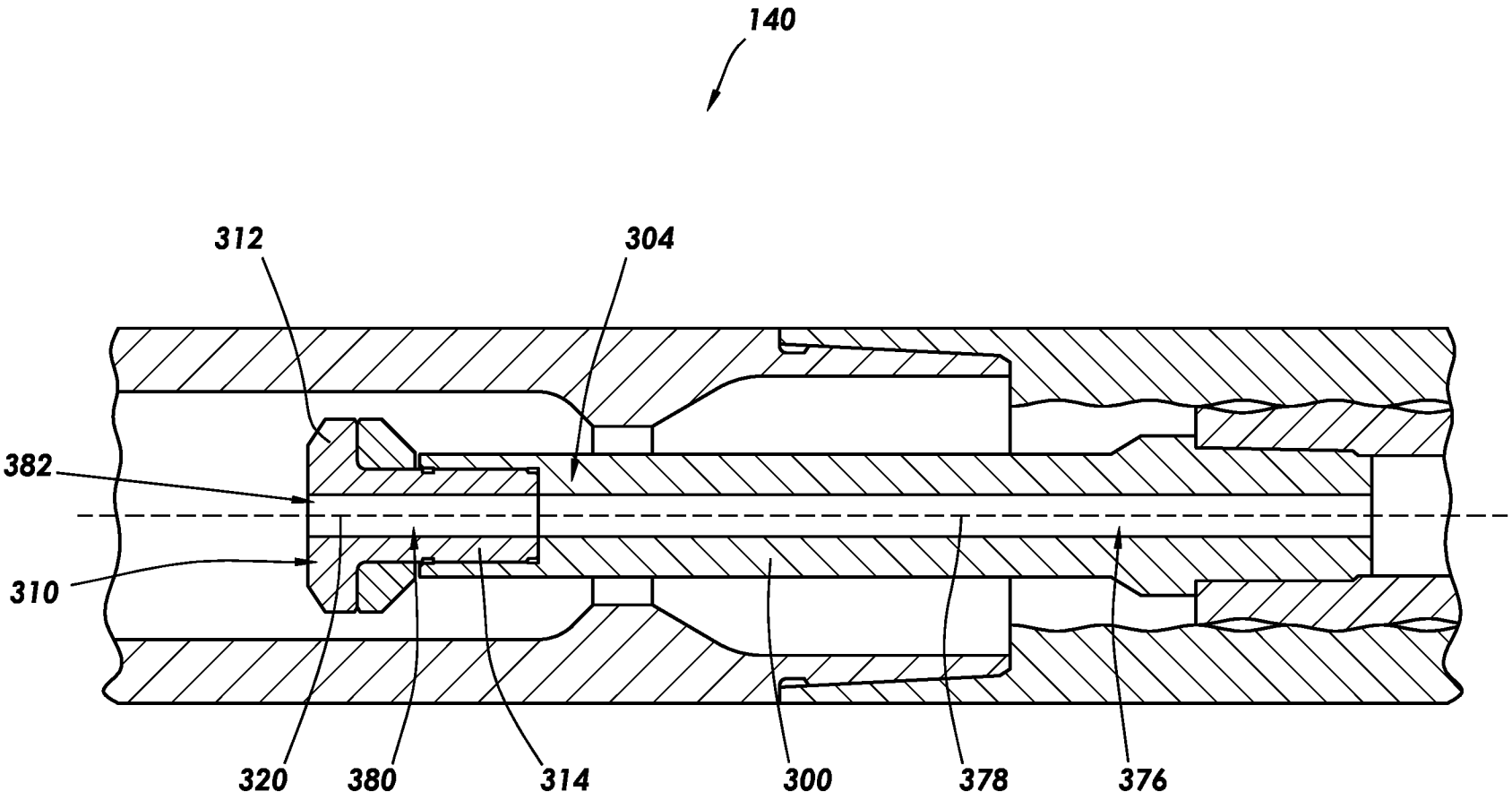
FIGS. 3C and 3D illustrate another cross-sectional view of the rotor catch system in the passive state and the active catch state, respectively, in accordance with example embodiments of the disclosure.

FIG. 3C illustrates a cross-sectional view of another example of the rotor catch system 140 of FIG. 3A in the passive state. As illustrated in FIG. 3C, the rotor catch system 140 includes a catch stem 300. Moreover, the rotor catch system 140 includes a catch feature 310 having a top portion 312 and a spindle portion 314. The spindle portion 314 is coupled to the distal end 304 of the catch stem 300. As illustrated, the catch stem 300 includes a catch stem bore 376 extending axially through the catch stem 300 along the central axis 378 of the catch stem 300. Further, the catch feature 310 includes a catch feature bore 380 extending axially through the catch feature 310 along the central axis 320 of the catch feature 310. The catch feature bore 380 extends through the top portion 312 and the spindle portion 314 of the catch feature 310. Moreover, the catch stem bore 376 and the catch feature bore 380 are coaxial. Together, the catch stem bore 376 and the catch feature bore 380 form a fluid passage 382 for drilling fluid to pass through the rotor catch system 140 in the passive state.

Figure 3D:
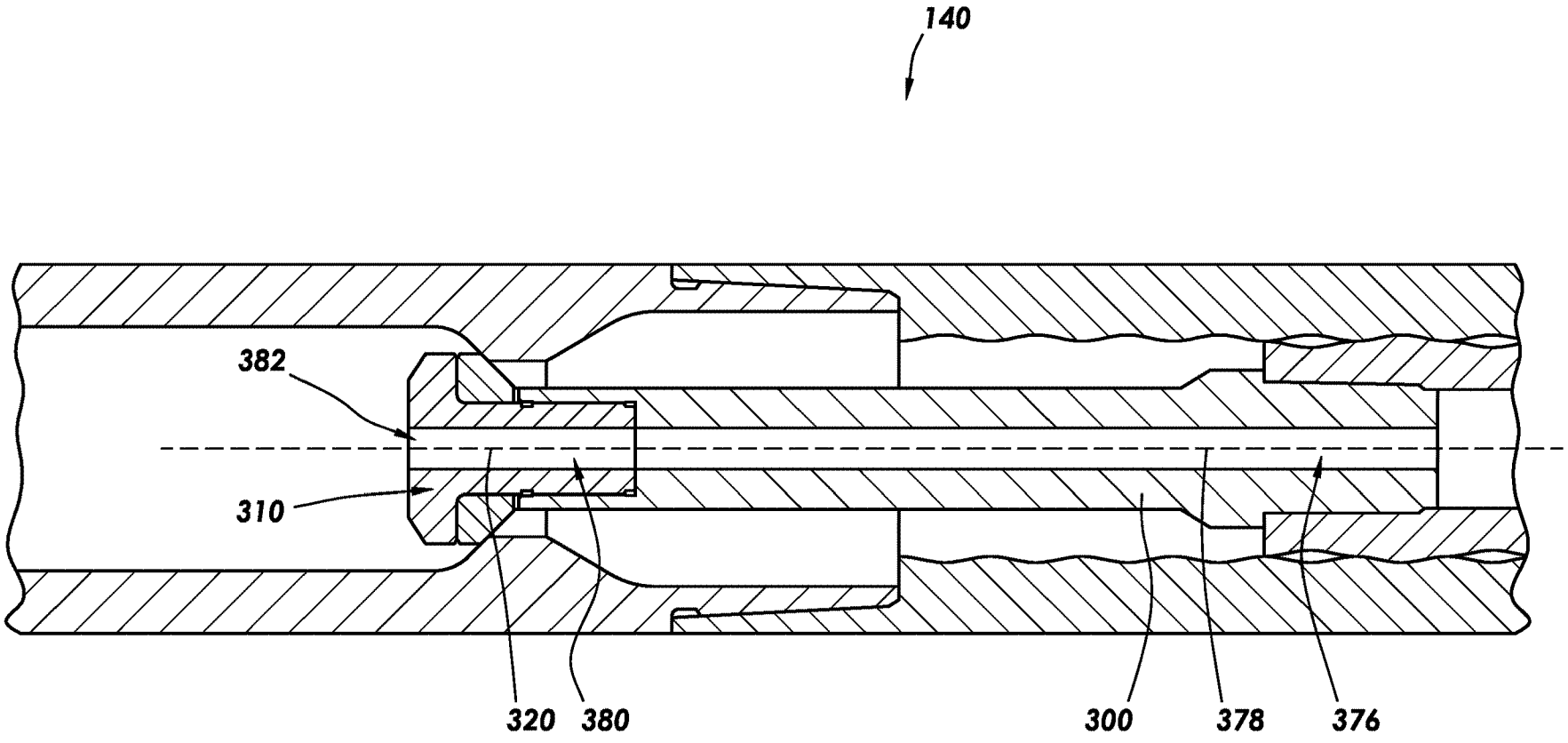

FIG. 3D illustrates a cross-sectional view of another example of the rotor catch system 140 of FIG. 3B in the active state. As set forth above, the rotor catch system 140 includes the catch stem bore 376 extending axially through the catch stem 300 along the central axis 378 of the catch stem 300. Further, the catch feature 310 includes the catch feature bore 380 extending axially through the catch feature 310 along the central axis 320 of the catch feature 310. The catch stem bore 376 and the catch feature bore 380 are coaxial. Moreover, the catch stem bore 376 and the catch feature bore 380 form the fluid passage 382 for drilling fluid to pass through the rotor catch system 140 in the active state.

Figure 4:
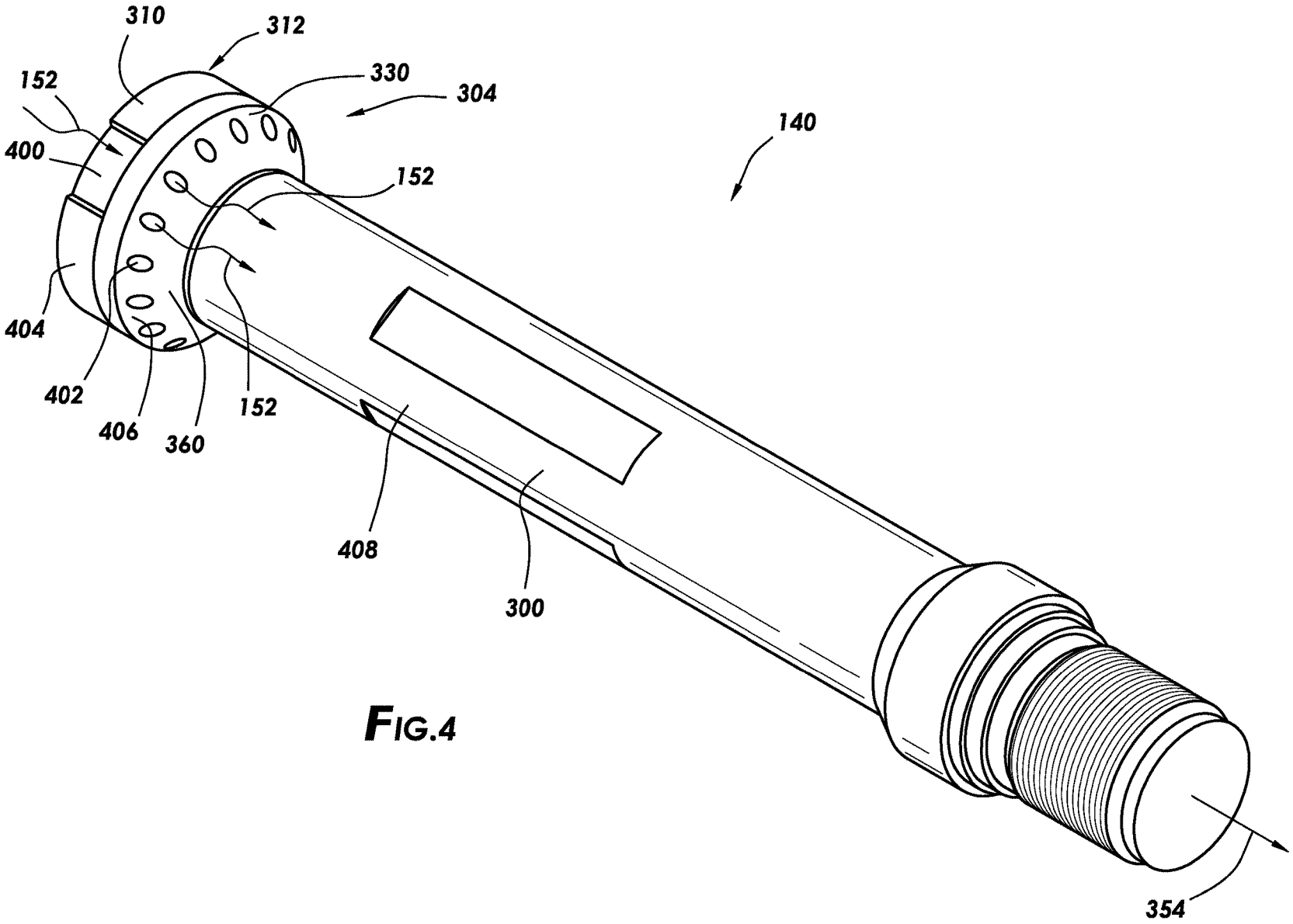
FIG. 4 illustrates a perspective view of the rotor catch assembly, in accordance with example embodiments of the disclosure.

FIG. 4 illustrates a perspective view of the rotor catch system 140, in accordance with example embodiments of the disclosure. As set forth above, rotor catch system 140 includes the catch feature 310 coupled to the distal end 304 of the catch stem 300. The rotor catch system 140 further includes the catch bushing 330 positioned downhole the top portion 312 of the catch feature 310. The catch feature 310 may include a plurality of slots 400. Further, the catch bushing 330 includes a plurality of bypass holes 402. As set forth above, the drilling fluid 152 flows through the drill string 108 during drilling operations. The drilling fluid 152 generally flows around the rotor catch system 140 when the rotor catch system 140 is in the passive state. That is, the drilling fluid 152 flows around a radial surface 404 of the catch feature 310, a radial surface 406 of the catch bushing 330, and a radial surface 408 of the catch stem 300.

However, in the active catch state, a portion of the radial surface 406 of the catch bushing 330 (e.g., the tapered bushing portion 360) is in contact with the housing catch feature 346, as illustrated in FIG. 3B. As such, the flow path 154 of the drilling fluid 152 around the catch bushing 330 is impeded in the active catch state.

To maintain well control in the active catch state, the catch feature 310 may include the plurality of slots 400, and the catch bushing 330 may include the plurality of bypass holes 402. For example, in the active catch state, the drilling fluid 152 flows from the surface 160 (as shown in FIG. 1) of the drilling operations to the catch feature 310. At the catch feature 310, the drilling fluid 152 flows through at least one slot of the plurality of slots 400. Thereafter, the drilling fluid 152 flows from the at least one slot of the plurality of slots 400 through at least one bypass hole of the plurality of bypass holes 402. From the plurality of bypass holes 402, the drilling fluid 152 flows in a downhole direction 354. As such, the drilling fluid flows through the drill string 108 in the active catch state.

Figure 5:
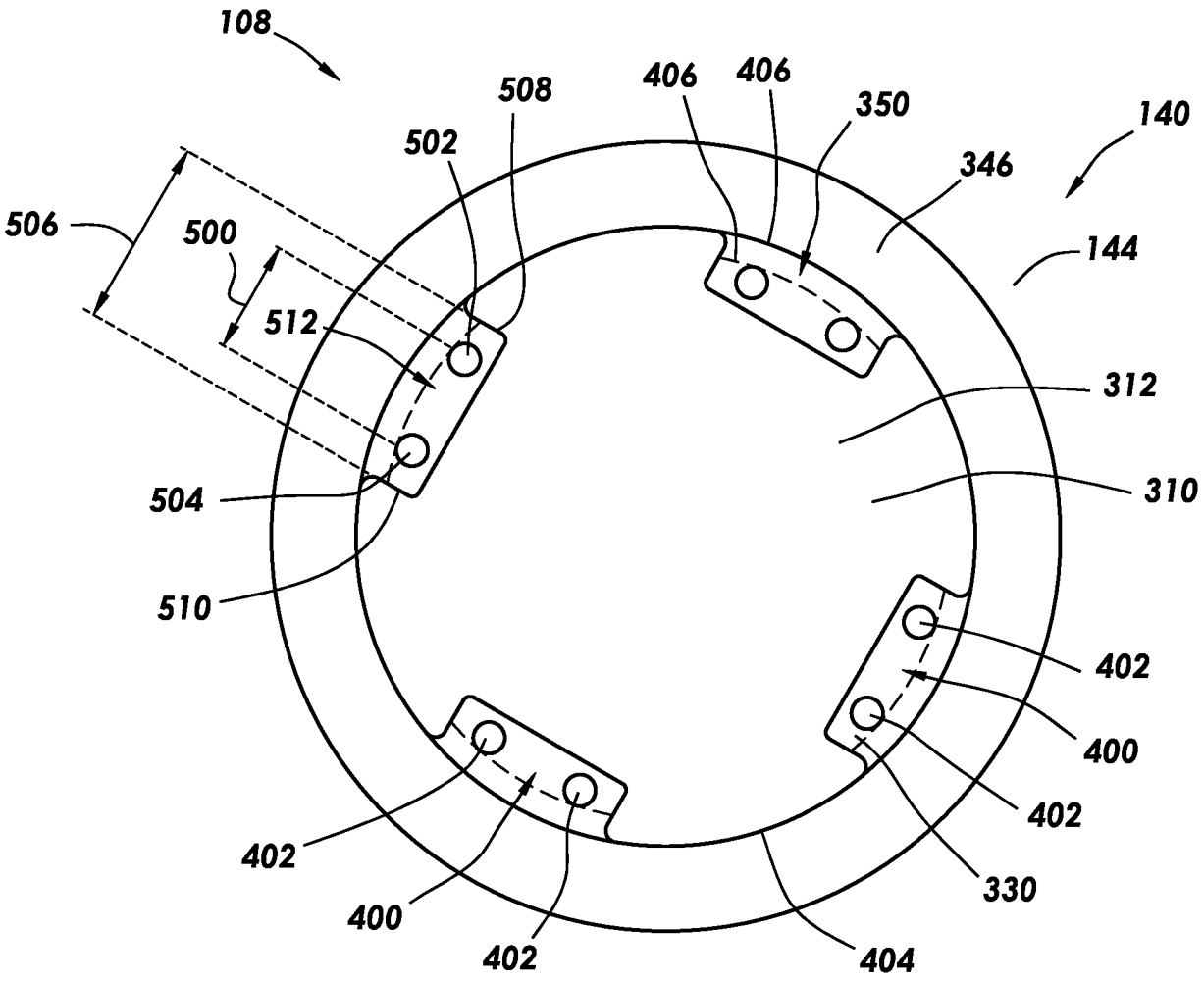
FIG. 5 illustrates a cross-sectional view of another embodiment of rotor catch assembly in the active catch state, in accordance with example embodiments of the disclosure.

FIG. 5 illustrates a cross-sectional view of another embodiment of the rotor catch system 140 in the active catch state, in accordance with example embodiments of the disclosure. As set forth above, the drilling fluid 152 (e.g., referring to FIG. 1) flows through the drill string 108 in the active catch state via the plurality of slots 400 in the catch feature 310 and the plurality of bypass holes 402 in the catch bushing 330. A flow rate of the drilling fluid 152 through the drill string 108 at the rotor catch system 140 is based at least in part on positioning and sizing of the plurality of slots 400 and the plurality of bypass holes 402. As set forth above, transitioning from passive state to the active catch state causes a pressure spike in the drilling fluid 152. A magnitude of the pressure spike is based at least in part on the positioning and sizing of the plurality of slots 400 and the plurality of bypass holes 402. Indeed, a change in the flow rate of the drilling fluid 152 between the passive state and the active catch state causes the pressure spike, and the positioning and sizing of the plurality of slots 400 and the plurality of bypass holes 402 determine the flow rate of the drilling fluid 152 in the active catch state.

The plurality of slots 400 may be formed in the radial surface 404 of the catch feature 310. In particular, the plurality of slots 400 is formed in the radial surface 404 of the top portion 312 of the catch feature 310. The plurality of slots 400 extend radially inward from the radial surface 404. Further, the plurality slots 400 extend through the axial length 328 of the top portion 312 of the catch feature. As shown, each slot of the plurality of slots 400 has a uniform shape and size. Alternatively, the shape and size of each slot of the plurality of slots 400 may vary. The plurality of slots 400 may be configured to interface with a securing tool during installation of the rotor catch system 140. In particular, the securing tool torques the top portion 312 of the catch feature 310 to thread the catch feature 310 into the catch stem 300. The securing tool is configured to thread the catch stem 300 to the rotor 136 of the mud motor via torque applied from the securing tool at the plurality of slots 400.

Moreover, the plurality of bypass holes 402 extend through the axial length 336 of the catch bushing 330. The plurality of bypass holes 402 may have a uniform cross section along the axial length 336 of the catch bushing 330. Alternatively, the plurality of bypass holes 402 may have anon-uniform cross section along the axial length 336 of the catch bushing 330. For example, the plurality of bypass holes 402 may be tapered such that each hole of the plurality of bypass holes 402 decreases in diameter along the axial length 336 of the catch bushing 330. Moreover, as illustrated, the plurality of bypass holes 402 may include a circular cross section. Alternatively, the plurality of bypass holes 402 may include any suitable cross section (e.g., ovular cross section, square cross section, etc.).

The plurality of bypass holes 402 may be positioned in a circular pattern proximate the radial surface 404 (e.g., outer edge) of the catch feature 310. The plurality of bypass holes 402 are spaced apart evenly around the circular pattern. Alternatively, the plurality of bypass holes 402 may be spaced apart unevenly around the circular pattern. Moreover, the plurality of bypass holes 402 are radially aligned with at least one slot of the catch feature 310. As set forth above, the catch feature 310 rotates with respect to the catch bushing 330 in the active catch state. As such, the plurality of slots 400 rotate with respect to the plurality of bypass holes 402. The plurality of bypass holes 402 are spaced such that at least one bypass hole 402 is axially aligned with the at least one slot of the plurality of slots 400 during rotation of the catch feature 310 in the active catch state. For example, a spacing distance 500 between a first bypass hole 502 and a second bypass hole 504 of the plurality of bypass holes 402 is less than a slot distance 506 between a first edge 508 and a second edge 510 of a first slot 512 of the plurality of slots 400. Further, the spacing distance 500 between the plurality of bypass holes 402 is uniform. As such, at least one bypass hole may be axially aligned with the plurality of slots 400 (e.g., the first slot 512) in the active catch state such that the drilling fluid 152 flows through the catch bushing 330 of the rotor catch system 140.

As shown, the plurality of bypass holes 402 may be positioned radially inward from the reduced inner diameter 350 of the sub housing 144 (e.g., the inner diameter of the housing catch feature 346) such that housing catch feature 346 does not block the drilling fluid 152 from passing through the plurality of bypass holes 402. Further, as set forth above, at least a portion of the radial surface 406 of the catch bushing 330 is in contact with the housing catch feature 346. Thus, the plurality of bypass holes 402 may be positioned radially inward from the portion of the radial surface 406 of the catch bushing 330 in contact with the housing catch feature 346.

Figure 6:
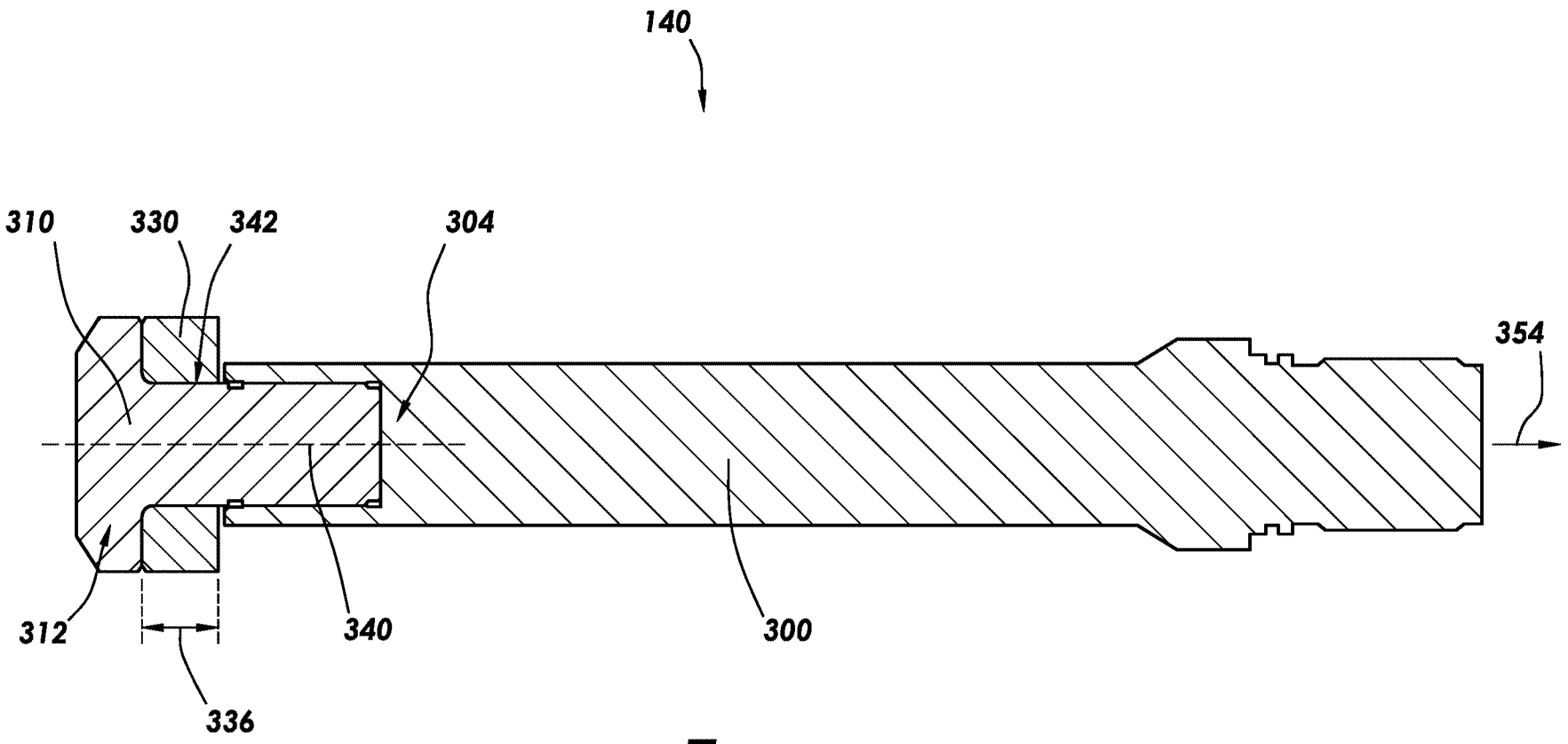
FIG. 6 illustrates a cross-sectional view of the rotor catch assembly, in accordance with example embodiments of the disclosure.

FIG. 6 illustrates a cross-sectional view of the rotor catch system 140, in accordance with example embodiments of the disclosure. As set forth above, rotor catch system 140 includes the catch feature 310 coupled to the distal end 304 of the catch stem 300. The rotor catch system 140 further includes the catch bushing 330 positioned in the downhole direction 354 from (i.e., downhole) the top portion 312 of the catch feature 310. Further, the catch bushing 330 is positioned between the top portion 312 of the catch feature and the distal end 304 of the catch stem 300. In the illustrated embodiment, the catch bushing 330 is annular with the axial bore 342 through the central axis 340 of the catch bushing 330. Moreover, a cross-section of the catch bushing 330 is uniform along the axial length 336 of the catch bushing 330. That is, the catch bushing 330 does not include a tapered portion. The catch bushing 330 having a uniform cross-section along the axial length 336 of the catch bushing 330 may provide benefits such as ease and reduced cost of manufacturing.

Figure 7:
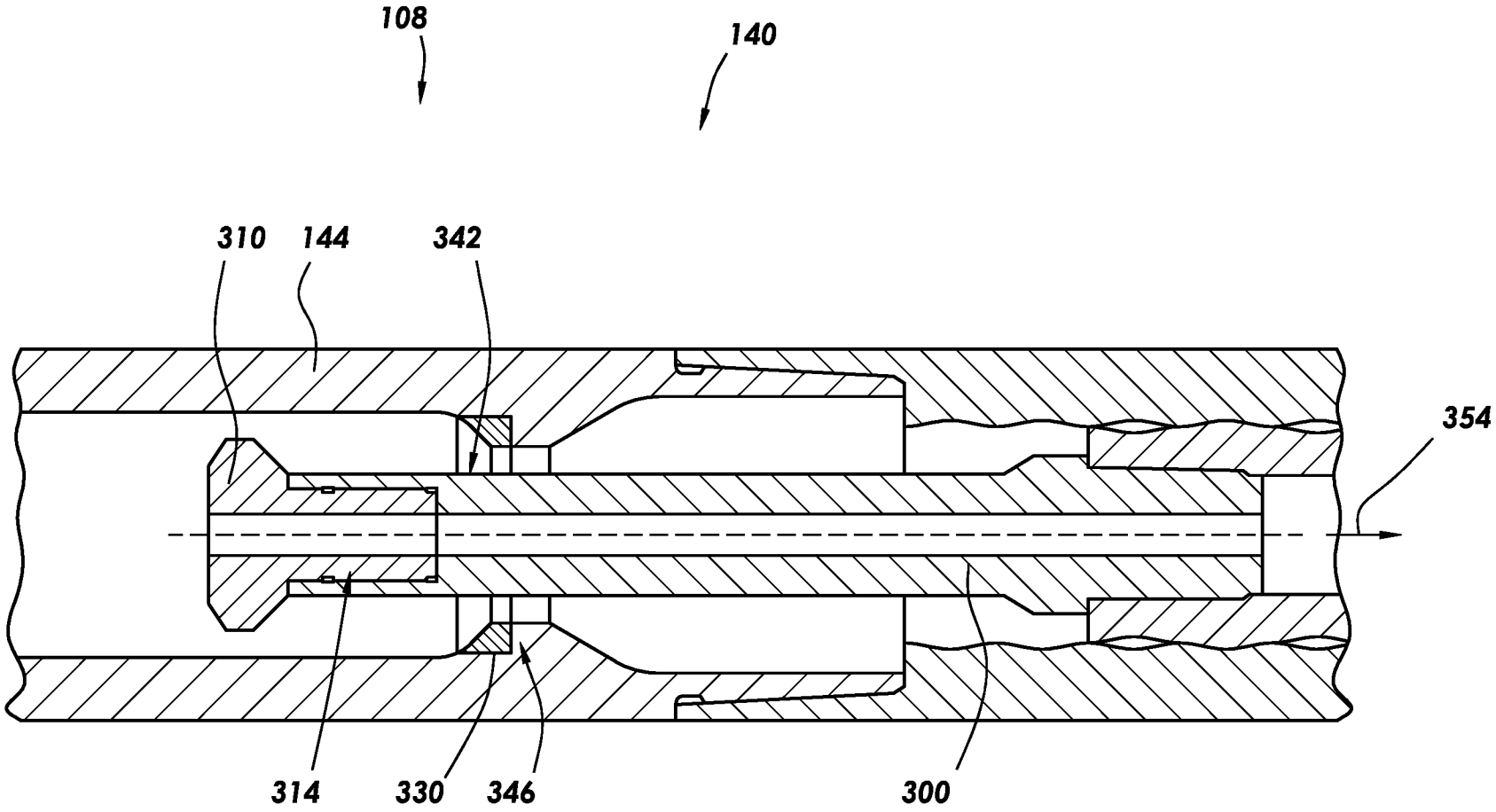
FIG. 7 illustrates illustrate cross-sectional views of the rotor catch system in the passive state in accordance with example embodiments of the disclosure.

FIG. 7 illustrates a cross-sectional view of the rotor catch system 140 in the passive state in accordance with example embodiments of the disclosure. As set forth above, the rotor catch system 140 includes the catch bushing 330. In the illustrated embodiment, the catch bushing 330 is coupled to the housing catch feature 346. However, the catch bushing 330 may be integral with the housing catch feature. Alternatively, the catch bushing 330 may be coupled to or integral with any portion of the sub housing 144 of the drill string 108. Moreover, in the illustrated embodiment, the rotor catch system 140 includes the catch feature 310 coupled to the catch stem 300. The catch bushing 330 is positioned in the downhole direction 354 from (i.e., downhole) the catch feature 310. Moreover, the catch feature 310 and the catch stem 300 are configured to move axially with respect to the catch bushing 330. The spindle portion 314 of the catch feature and the catch stem 300 is configured to slide through the axial bore 342 of the catch bushing 330. Further, the catch feature and the catch stem 300 are configured to rotate with respect to the catch bushing 330.

Accordingly, the preceding description provides systems and methods for wellbore drilling and, more particularly, example embodiments may include a rotor catch system configured to provide an indication of a mud motor failure to the surface and configured to prevent milling of the rotor catch system through a housing of the rotor catch system to maintain a connection with a portion of the mud motor system separated due to the mud motor failure. The systems, methods, and apparatus may include any of the various features disclosed herein, including one or more of the following statements.

Statement 1. A rotor catch system may comprise a catch stem having a proximal end coupled to a rotor of a mud motor system and a distal end at least partially positioned within a sub housing of a drill string; a catch feature having a top portion and a spindle portion extending from the top portion and coupled to the distal end of the catch stem; a housing catch feature extending radially inward from an inner surface of the sub housing of the drill string; and a catch bushing positioned between the top portion of the catch feature and the housing catch feature, wherein the catch feature and the catch stem rotate with respect to the catch bushing in an active catch state, wherein the housing catch feature restrains axial movement of the catch bushing in at least one direction in the active catch state via contact between the catch bushing and the housing catch feature, and wherein the catch bushing restrains axial movement of the catch feature in the at least one direction in the active catch state via contact between the catch feature and the catch bushing.

Statement 2. The rotor catch system of statement 1, wherein the catch bushing is positioned between the catch stem and the top portion of the catch feature.

Statement 3. The rotor catch system of any proceeding statement, wherein an axial position of the top portion is fixed with respect to the catch stem, and wherein a distance between the top portion and the catch stem is between 0.01 inches to 0.09 inches greater than an axial length of the catch bushing.

Statement 4. The rotor catch system of any proceeding statement, wherein the catch feature is rigidly coupled to the distal end of the catch stem.

Statement 5. The rotor catch system of any proceeding statement, wherein the catch feature includes a plurality of slots.

Statement 6. The rotor catch system of any proceeding statement, wherein the catch bushing includes a plurality of bypass holes, and wherein at least one bypass hole of the plurality of bypass holes is radially aligned with at least one slot of the catch feature in the active catch state.

Statement 7. The rotor catch system of any proceeding statement, wherein the plurality of bypass holes is positioned in a circular pattern proximate an outer edge of the catch feature.

Statement 8. The rotor catch system of any proceeding statement, wherein the at least one direction is a downhole direction.

Statement 9. The rotor catch system of any proceeding statement, wherein the sub housing of the drill string is coupled to a stator of the mud motor system, and wherein the rotor is positioned at least partially within the stator.

Statement 10. The rotor catch system of any proceeding statement, wherein the catch bushing includes a tapered bushing portion along at least a portion of an axial length of the catch bushing.

Statement 11. The rotor catch system of any proceeding statement, wherein the housing catch feature includes a housing tapered portion configured to contact the tapered bushing portion in the active catch state.

Statement 12. The rotor catch system of any proceeding statement, wherein the spindle portion is configured to extend axially through the catch bushing and at least a portion of the distal end of the catch stem.

Statement 13. The rotor catch system of any of claims 1, 4, 5, 7, and 9-12, wherein the catch bushing is coupled to the housing catch feature.

Statement 14. A mud motor system may comprise a stator coupled to a sub housing of a drill string; a rotor disposed at least partially within the stator that rotates in response to fluid flow through the stator; a transmission section positioned downhole the stator that transfers torque from the rotor to a drill bit to cause the drill bit to rotate; a catch stem having a proximal end coupled to the rotor and a distal end positioned within the sub housing of the drill string; a catch feature having a top portion and a spindle portion extending from the top portion and coupled to the distal end of the catch stem; a catch bushing positioned between the catch stem and the top portion of the catch feature, wherein the catch feature and the catch stem rotate with respect to the catch bushing in an active catch state, wherein the catch bushing restrains axial movement of the catch feature in the active catch state; and a housing catch feature extending radially inward from an inner surface of the sub housing of the drill string, wherein the housing catch feature restrains axial movement of the catch bushing with respect to the sub housing in the active catch state via contact between the catch bushing and the housing catch feature.

Statement 15. The mud motor system of statement 14, wherein the active catch state is triggered in response to the contact between the catch bushing and the housing catch feature caused by axial movement of the catch stem with respect to the sub housing.

Statement 16. The mud motor system of statements 14 or 15, wherein a mechanical disconnection of a portion of the drill string positioned downhole from the housing catch feature causes the axial movement of the catch stem with respect to the sub housing.

Statement 17. A method may comprise restraining movement of a rotor in a mud motor system in response to axial movement of the rotor through contact between a housing catch feature and a catch bushing installed on the rotor; generating a pressure spike in a wellbore fluid up hole from the catch bushing via at least a partial seal formed between the housing catch feature and the catch bushing; and detecting the pressure spike via at least one pressure transducer which indicates that the rotor moved axially with respect to a portion of a drill string positioned up hole from the catch bushing based at least in part on the detected pressure spike.

Statement 18. The method of statement 17, wherein the pressure transducer is positioned above a surface of a wellbore.

Statement 19. The method of statement 17, wherein the pressure transducer is positioned in a wellbore.

Statement 20. The method of any of statements 17-19, wherein the detected pressure spike includes a pressure differential between 300 pounds per square inch (psi) to 700 psi (2068 kilopascals [kPa] to 4826 kPa).

It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A rotor catch system, comprising:

a catch stem having a proximal end coupled to a rotor of a mud motor system and a distal end at least partially positioned within a sub housing of a drill string;

a catch feature having a top portion and a spindle portion extending from the top portion and coupled to the distal end of the catch stem;

a housing catch feature extending radially inward from an inner surface of the sub housing of the drill string; and a catch bushing positioned between the top portion of the catch feature and the housing catch feature, wherein the catch feature and the catch stem rotate with respect to the catch bushing in an active catch state, wherein the housing catch feature restrains axial movement of the catch bushing in at least one direction in the active catch state via contact between the catch bushing and the housing catch feature, and wherein the catch bushing restrains axial movement of the catch feature in the at least one direction in the active catch state via contact between the catch feature and the catch bushing.

2. The rotor catch system of claim 1, wherein the catch bushing is positioned between the catch stem and the top portion of the catch feature.

3. The rotor catch system of claim 1, wherein an axial position of the top portion is fixed with respect to the catch stem, and wherein a distance between the top portion and the catch stem is between 0.01 inches to 0.09 inches greater than an axial length of the catch bushing.

4. The rotor catch system of claim 1, wherein the catch feature is rigidly coupled to the distal end of the catch stem.

5. The rotor catch system of claim 1, wherein the catch feature includes a plurality of slots.

6. The rotor catch system of claim 5, wherein the catch bushing includes a plurality of bypass holes, and wherein at least one bypass hole of the plurality of bypass holes is radially aligned with at least one slot of the catch feature in the active catch state.

7. The rotor catch system of claim 6, wherein the plurality of bypass holes is positioned in a circular pattern proximate an outer edge of the catch feature.

8. The rotor catch system of claim 1, wherein the at least one direction is a downhole direction.

9. The rotor catch system of claim 1, wherein the sub housing of the drill string is coupled to a stator of the mud motor system, and wherein the rotor is positioned at least partially within the stator.

10. The rotor catch system of claim 1, wherein the catch bushing includes a tapered bushing portion along at least a portion of an axial length of the catch bushing.

11. The rotor catch system of claim 10, wherein the housing catch feature includes a housing tapered portion configured to contact the tapered bushing portion in the active catch state.

12. The rotor catch system of claim 1, wherein the spindle portion is configured to extend axially through the catch bushing and at least a portion of the distal end of the catch stem.

13. The rotor catch system of claim 1, wherein the catch bushing is coupled to the housing catch feature.

14. A mud motor system, comprising:

a stator coupled to a sub housing of a drill string;

a rotor disposed at least partially within the stator that rotates in response to fluid flow through the stator;

a transmission section positioned downhole the stator that transfers torque from the rotor to a drill bit to cause the drill bit to rotate;

a catch stem having a proximal end coupled to the rotor and a distal end positioned within the sub housing of the drill string;

a catch feature having a top portion and a spindle portion extending from the top portion and coupled to the distal end of the catch stem;

a catch bushing positioned between the catch stem and the top portion of the catch feature, wherein the catch feature and the catch stem rotate with respect to the catch bushing in an active catch state, wherein the catch bushing restrains axial movement of the catch feature in the active catch state; and a housing catch feature extending radially inward from an inner surface of the sub housing of the drill string, wherein the housing catch feature restrains axial movement of the catch bushing with respect to the sub housing in the active catch state via contact between the catch bushing and the housing catch feature.

15. The mud motor system of claim 14, wherein the active catch state is triggered in response to the contact between the catch bushing and the housing catch feature caused by axial movement of the catch stem with respect to the sub housing.

16. The mud motor system of claim 14, wherein a mechanical disconnection of a portion of the drill string positioned downhole from the housing catch feature causes the axial movement of the catch stem with respect to the sub housing.

17. A method, comprising:

restraining movement of a rotor in a mud motor system in response to axial movement of the rotor through contact between a housing catch feature and a catch bushing, wherein the rotor is coupled to a catch feature via a catch stem, and wherein the catch bushing is positioned between the catch stem and a top portion of the catch feature;

generating a pressure spike in a wellbore fluid up hole from the catch bushing via at least a partial seal formed between the housing catch feature and the catch bushing, wherein the wellbore fluid may flow through the partial seal toward the rotor at a reduced flow rate via at least one slot formed in the catch feature and at least one bypass hole formed in the catch bushing; and detecting the pressure spike via at least one pressure transducer which indicates that the rotor moved axially with respect to a portion of a drill string positioned up hole from the catch bushing based at least in part on the detected pressure spike.

18. The method of claim 17, wherein the pressure transducer is positioned above a surface of a wellbore.

19. The method of claim 17, wherein the pressure transducer is positioned in a wellbore.

20. The method of claim 17, wherein the detected pressure spike includes a pressure differential between 300 pounds per square inch (psi) to 700 psi (2068 kilopascals [kPa] to 4826 kPa).

* * * * *